US006289955B1

(12) United States Patent
Wilhelm

(10) Patent No.: US 6,289,955 B1
(45) Date of Patent: Sep. 18, 2001

(54) ADJUSTABLE, PORTABLE WOOD SPLITTING APPARATUS

(76) Inventor: Eugene Wilhelm, 1102 1/2 Scott St., LaPorte, IN (US) 46350

( * ) Notice: Subject to any disclaimer, the term of this patent is extended or adjusted under 35 U.S.C. 154(b) by 0 days.

(21) Appl. No.: 09/663,130

(22) Filed: Sep. 15, 2000

(51) Int. Cl.[7] ..... B27L 7/00

(52) U.S. Cl. ..... 144/195.4; 144/193.1; 144/195.5; 144/366

(58) Field of Search ..... 144/193.1, 195.4, 144/195.5, 366

(56) References Cited

U.S. PATENT DOCUMENTS 881,538 * 3/1908 Bienk ..... 144/195.4
4,244,407 * 1/1981 McMullin ..... 144/195.4
5,547,001 * 8/1996 Cumming et al. ..... 144/195.5

FOREIGN PATENT DOCUMENTS

383707 * 10/1923 (DE) ..... 144/195.4

* cited by examiner

*Primary Examiner*—W Donald Bray
(74) *Attorney, Agent, or Firm*—John D. Gugliotta

(57) ABSTRACT

An adjustable, portable wood splitting apparatus is provided having a pair of linearly elongated, telescoping cylindrical base members forming a V-shaped base diverging outwardly from an apex, a bracket base member, a linearly elongated, vertically extending handle support post, a linearly elongated, telescoping handle mounted above the apex and on a vertically extending handle support post, and a wedge vertically affixed to the handle.

7 Claims, 6 Drawing Sheets

ADJUSTABLE, PORTABLE WOOD SPLITTING APPARATUS

RELATED APPLICATIONS

The present invention was first described in Disclosure Document No. 469,345 filed on Feb. 18, 2000. There are no previously filed, nor currently any co-pending applications, anywhere in the world.

BACKGROUND OF THE INVENTION

1. Field of the Invention

The present invention relates generally to wood splitting devices and, more particularly, to an adjustable, portable wood splitting apparatus.

2. Description of the Related Art

Firewood from cut trees is used in fires all over the world on a daily basis. Whether the fire is for heating, lighting, general ambience or the like in a home or at a campsite, the wood must be cut and split for the fire. A common method of splitting the wood in the past has been with the use of a maul and a wedge or an ax. While this method has worked, it is not very accurate and can be tiring and dangerous for the user. Recent methods include the use of the hydraulic wood splitter powered by a gasoline engine. These however are noisy, consume natural resources and pollute the environment. Also, and perhaps most important, these hydraulic wood splitters are costly even to rent and are not available in all areas of the world.

Accordingly, there is a need for a means by which firewood can be split in a safe and easy manner with minimal impact on the environment. The development of the adjustable, portable wood splitting apparatus fulfills this need.

A search of the prior art did not disclose any patents that read directly on the claims of the instant invention; however, the following references were considered related. The following patents disclose a wood splitter mounted on a trailer or truck bed: U.S. Pat. No. 5,651,404 issued in the name of Kraemer et al.; U.S. Pat. No. 4,945,960 issued in the name of McCauley; U.S. Pat. No. 4,667,712 issued in the name of Hudson et al.; and U.S. Pat. No. 4,086,111 issued in the name of Corey.

The following patents describe the design and function of a wood splitting maul: U.S. Pat. No. 5,482,097 issued in the name of Maine; U.S. Pat. No. 5,394,917 issued in the name of Maine; and U.S. Pat. No. D 378,656 issued in the name of Maine.

U.S. Pat. No. 4,799,519 issued in the name of Forbes et al. discloses a wood splitting machine with a carriage and blade assembly.

U.S. Pat. No. 4,354,537 issued in the name of Balkus describes an apparatus for splitting logs with a fulcrum pin.

Consequently, a need has been felt for providing a device which allows wood logs to be split into firewood using human strength alone with minimal impact on the environment in a manner which is quick, easy and efficient.

SUMMARY OF THE INVENTION

Therefore, it is an object of the present invention to provide a human powered log splitter which splits logs into usable firewood and which utilizes a fulcrum and lever to magnify human strength.

It is another object of the present invention to provide a device which utilizes a fulcrum and lever system for providing cutting strength, great exercise for the user, conservation of natural resources, completely quiet operation, and no reliance on external power sources.

It is still another object of the present invention to provide a splitting wedge being adjustable for log width, can be sharpened by the user and replaced should it become damaged.

It is still another object of the present invention to provide a device having an extendable handle which allows for ease of storage and portability.

Briefly described according to one embodiment of the present invention, an adjustable, portable wood splitting apparatus is provided to aid in the splitting of firewood. A pair telescoping cylindrical base members forming a V-shaped base provide a retractable device being easily transportable. Each of the pair of base members includes an inner member telescoping inside an outer member.

Each of the base members are held into their desired position via a spring-loaded pin assembly.

A base platform, welded to an upper surface of the outer members of the base members above a handle support post, serves as a platform upon which an end of a log can be supported.

The inner members include a handle guide support platform serving as a firm base upon which a handle guide track member can be supported.

The support platform is of a generally rectangular shape formed of flattened steel, tapering in a direction towards an apex so as to be fittingly welded to the inner members.

Mounted above the apex and on opposing vertical internal sidewalls of the outer members is a vertically extending handle support post.

The handle support post is constructed of steel and has a handle receiving slot formed as a recess along an upper surface thereof for receiving an outer member of a handle.

To provide structural stability, a hollow, rectangular bracket base member constructed of steel is mounted perpendicularly at the apex of the base members.

To provide structural stability to the handle support post, a pair of L-shaped support post brackets are welded to the bracket base member and the handle support post.

The adjustable, portable wood splitting apparatus is actuated by a linearly elongated, telescoping handle being movable between a raised position and a lower position. The telescoping handle is held into a desired position via a spring-loaded pin assembly.

For providing a fulcrum whereupon a lever mechanism is established, an end of the handle is received by a handle receiving slot of the handle support post. The end of the handle is securely held in the receiving slot via a fulcrum pin.

The handle is further defined as having a handle grip at an end opposite the fulcrum pin. The handle grip is defined as having a plurality of finger-gripping channels to allow a user to obtain a firm and comfortable grasp of the handle.

A handle guide track member, of an arcuate configuration and having a base from which a pair of elongated track arms extend vertically therefrom, is located perpendicularly at a posterior end of an outer member of the handle and below the pin assembly. The handle guide track member is designed and configured so as to slidably receive the handle therein. Each of the track arms having linearly elongated slots formed therein for slidably receiving a guide pin.

To prevent lateral spreading of the track arms, a stabilizing bolt is inserted through apertures above the elongated slots through the track arms.

A wedge is disclosed being generally triangular in cross-section having a downwardly directed, sharpened cutting edge.

An L-shaped arm is welded perpendicularly along an upper surface of the wedge allowing for the lateral selective adjustment of the wedge. The L-shaped arm cooperates with a plurality of holes linearly aligned along a length of the outer member of the handle.

A track assembly comprising a linearly elongated channel and a brace is disclosed in order to securely hold a log in place once positioned on the base platform and to facilitate lateral movement by the brace along the base platform.

In order to prevent inadvertent movement by the present invention during operation, a plurality of friction pads are mounted to a lower surface of corners of the bracket base member, the outer members of the base members, and the inner members of the base members.

The use of the present invention allows wood logs to be split into firewood using human strength alone with minimal impact on the environment in a manner which is quick, easy and efficient.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
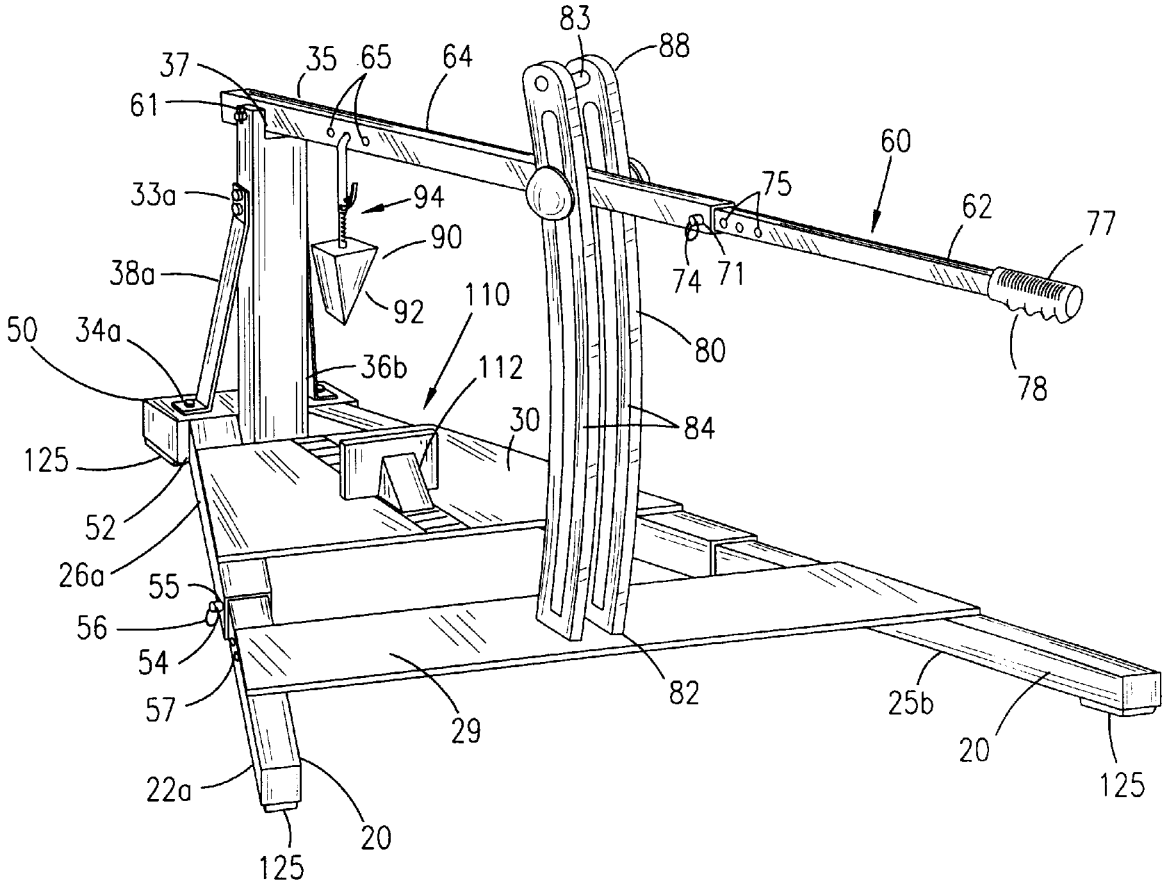
FIG. 1 is a perspective view of an adjustable, portable wood splitting apparatus according to the preferred embodiment of the present invention.

Referring now to FIGS. 1–4, an adjustable, portable wood splitting apparatus 10 is shown, according to the present invention, comprised of a pair of linearly elongated, telescoping cylindrical base members 20 forming a V-shaped base, a bracket base member 50, a linearly elongated, vertically extending handle support post 35, a linearly elongated, telescoping handle 60, and a wedge 90.

Each of the pair of base members 20 is of a generally rectangular configuration and includes an inner member 22*a,* 22*b* telescoping inside an outer member 26*a,* 26*b* for providing a retractable device being easily transportable.

The base members 20 diverge outwardly from an apex 30 so as to form a V-shaped base. Each of the inner members 22*a,* 22*b* having an anterior end 23*a,* 23*b* opposite a posterior end 24*a,* 24*b,* respectively.

Each of the outer members 26*a,* 26*b* having an anterior end 27*a,* 27*b* opposite a posterior end 28*a,* 28*b,* respectively.

The anterior end 23*a,* 23*b* of each of the inner members 22*a,* 22*b* telescopes inside the posterior end 28*a,* 28*b* of each of the outer members 26*a,* 26*b,* respectively.

Once a desired length of each of the base members 20 has been provided, each inner member 22*a,* 22*b* and outer member 26*a,* 26*b* can be held into their desired position via a spring-loaded pin assembly 53. The pin assembly 53 is designed so as to cooperate with a plurality of holes 57 aligned along a length at the anterior end 23*a,* 23*b* of a vertical sidewall of the inner member 22*a,* 22*b.*

The spring-loaded pin assembly 53 includes a spring-loaded pin 54, of a linearly elongated configuration, being located at an end of the outer member 26*a,* 26*b* which extends through a hole 55 in the outer member 26*a,* 26*b* positioned laterally, and capable of lateral movement via a spring-loaded pin handle 56.

The inner member 22*a,* 22*b,* the outer member 26*a,* 26*b* and the spring-loaded pin 54 are configured such that, when the spring-loaded pin 54 is in a resting position, the inner member 22*a,* 22*b* and outer member 26*a,* 26*b* are locked into position by mechanical interference between the spring-loaded pin 54 extending through a hole 55 in the outer member 26*a,* 26*b* through a hole 57 in the inner member 22*a,* 22*b.* Retraction of the spring-loaded pin 54 removes the mechanical interference, thus permitting the inner member 22*a,* 22*b* to be extended away from or retracted into the outer member 26*a,* 26*b.* As such, the length of each of the base members 20 are mechanically adjustable, thereby providing various linear lengths and allowing for ease of transportation of the device. It is envisioned that each base member 20 would be capable of extending a length of approximately 72 inches.

An upper surface of a base platform 30 serves as a platform upon which an end of a log can be supported. The base platform 30 is formed of flattened steel of a generally rectangular configuration, tapering in a direction towards the apex 30. The base platform 30 is welded to an upper surface of the outer members 26*a,* 26*b* of the base members 20 above a handle support post 35 (as will be described in greater detail below) and extending to the posterior end 28*a,* 28*b* of the outer members 26*a,* 26*b.*

The inner members 22*a,* 22*b* include a handle guide support platform 29 serving as a firm base upon which a handle guide track member (as will be described in greater detail below) can be supported.

The support platform 29 is of a generally rectangular shape formed of flattened steel, tapering in a direction towards the apex 30 so as to be fittingly welded on opposing vertical sidewalls 25*a,* 25*b* at the anterior end 23*a,* 23*b* of the inner members 22*a,* 22*b.* The support platform 29 having a vertical sidewall measurement equal to the vertical internal sidewall measurement of the inner members 22*a,* 22*b,* whereby the support platform 29 forming a bridge providing a flat surface extending from inner member 22*a* to inner member 22*b.*

Mounted above the apex 30 and on opposing vertical internal sidewalls 21*a,* 21*b* at the anterior end 27*a,* 27*b* of the outer members 26*a,* 26*b* is a vertically extending handle support post 35.

The handle support post 35 is of a generally rectangular, hollow configuration constructed of steel and having a handle receiving slot 37 formed as a recess along an upper surface thereof for receiving an anterior end 67 of an outer member 64 of a handle 60 (as will be described in greater detail below). It is envisioned that the height of the handle support post 35 measures approximately 16 inches.

To provide structural stability, a linearly elongated, hollow, rectangular bracket base member 50 constructed of steel is disclosed. The bracket base member 50 is mounted perpendicularly at the apex of the V-shaped base members 20. The bracket base member 50 having a slot 52 formed as a recess along a linearly elongated centerline thereof between a lower surface and an internal vertical sidewall of the bracket base member 50 and running an entire linear length thereof.

The slot 52 is designed and configured so as to fittingly receive the apex 30 of the base members 20 and be welded thereto. The bracket base member 50 may also be bolted or clamped to the apex 30 of the base members 20; however, welding is the preferred method for permanent attachment. As bolts require holes, this method of attachment will leave surfaces exposed thereby being more susceptible to rust.

To provide structural stability to the handle support post 35, a pair of L-shaped support post brackets 38*a,* 38*b* having an anterior end 33*a,* 33*b* opposite a posterior end 34*a,* 34*b* are welded to the bracket base member 50 and the handle support post 35.

The anterior end 33*a,* 33*b* of each support post bracket 38*a,* 38*b* is welded to a vertical sidewall 36*a,* 36*b* respectively of the handle support post 35.

The posterior end 34*a,* 34*b* of each support post bracket 38*a,* 38*b* is welded at opposed ends of an upper surface of the bracket base member 50.

The support post brackets 38*a,* 38*b* may also be bolted to the handle support post 35 and the bracket base member 50; however, welding is the preferred method for permanent attachment. As bolts require holes, this method of attachment will leave surfaces exposed thereby being more susceptible to rust.

Figure 4:
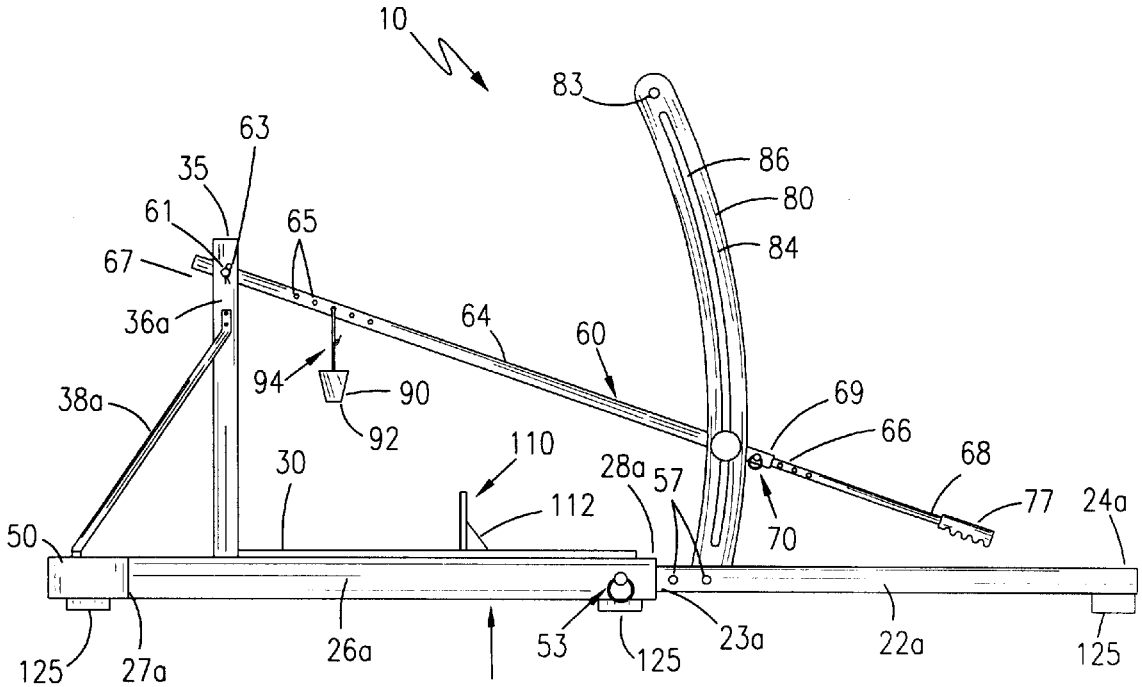
FIG. 4 is a side elevational view of the present invention according to the preferred embodiment shown with a handle in a lower position.

The adjustable, portable wood splitting apparatus 10 is actuated by a linearly elongated, telescoping handle 60 being movable between a raised position (FIGS. 1 and 2) and a lower position (FIG. 4).

The handle 60 includes an inner member 62, telescoping within an outer member 64 for providing a user with added leverage-when needed. The handle 60 is positioned with respect to the base members 20 such that the handle 60 bisects the V-shaped angle formed by the base members 20.

The inner member 62 has an anterior end 66, opposite a posterior end 68. The outer member 64 has an anterior end 67, opposite a posterior end 69.

The inner member 62 and outer member 64 can be held into their desired position via a spring-loaded pin assembly 70. The pin assembly 70 is designed so as to cooperate with a plurality of holes 75 aligned along a length at the anterior end 66 of the inner member 62.

The spring-loaded pin assembly 70 includes a spring-loaded pin 71, of a linearly elongated configuration, being located at the posterior end 69 of the outer member 64 which extends through a hole 72 in the outer member 64 positioned laterally, and capable of lateral movement via a spring-loaded pin handle 74.

The inner member 62, the outer member 64 and the spring-loaded pin 71 are configured such that, when the spring-loaded pin 71 is in a resting position, the inner member 62 and outer member 64 are locked into position by mechanical interference between the spring-loaded pin 71 extending through a hole 72 in the outer member 64 through a hole 75 in the inner member 62. Retraction of the spring-loaded pin 71 removes the mechanical interference, thus permitting the inner member 62 to be extended away from or retracted into the outer member 64. As such, the length of the handle 60 is mechanically adjustable and can provide various linear lengths. It is envisioned that the handle 60 would be capable of extending a length of approximately 60 inches.

For providing a fulcrum whereupon a lever mechanism is established, the anterior end 67 of the outer member 64 of the handle 60 is received by a handle receiving slot 37 of the handle support post 35.

For securing the anterior end 67 of the outer member 64 of the handle 60 within the handle receiving slot 37, an aperture pierces the vertical sidewall 36*a,* 36*b* of the handle support post 35 above the support post brackets 38*a,* 38*b* for receiving a fulcrum pin 61 which extends through the anterior end 67 of the outer member 64 of the handle 60. The fulcrum pin 61 is held in place via a cotter pin 63. It is envisioned that the fulcrum pin 61 can be welded or otherwise permanently mounted to the anterior end 67 of the outer member 64 of the handle 60.

A plurality of holes 65, linearly aligned along a length of the outer member 64 of the handle 60 are formed so as to removably receive a wedge 90 (as will be described in greater detail below).

The handle 60 is further defined as having a handle grip 77 at the posterior end 68 of the inner member 62. The handle grip 77 is defined as having a plurality of finger-gripping channels 78 to allow a user to obtain a firm and comfortable grasp of the handle 60. It is envisioned that the handle grip 77 is formed of plastic or other material capable of injection molding, and therefore can be formed easily of recycled material.

A handle guide track member 80 located perpendicularly at the posterior end 69 of the outer member 64 of the handle 60 and below the pin assembly 70 is disclosed for slidably receiving the handle 60 therein.

The track member 80 is of an arcuate configuration having a base 82 from which a pair of elongated track arms 84 extend vertically therefrom. Each of the track arms 84 having linearly elongated slots 86 formed therein for slidably receiving a guide pin 88.

The guide pin 88 extends laterally through the elongated slots 86 of the track arms 84 through the posterior end 69 of the outer member 64 of the handle 60. The guide pin 88 further having ears 89 formed at ends thereof for preventing removal of the guide pin 88.

Having a flat lower surface, the base 82 of the track member 80 is removably positioned on an upper surface of the support platform 29 which serves as a firm base upon which the track member 80 can be supported.

To prevent lateral spreading of the track arms 84, a stabilizing bolt 83 is inserted through apertures above the elongated slots 86 through the track arms 84.

The handle guide track member 80 being designed and configured so as to allow the handle 60 to slide within the track member 80 in an arcing motion as it is moved between a raised position and a lower position, while simultaneously aiding in the prevention of linear articulative motion by the handle 60 during such motion.

Figure 2:
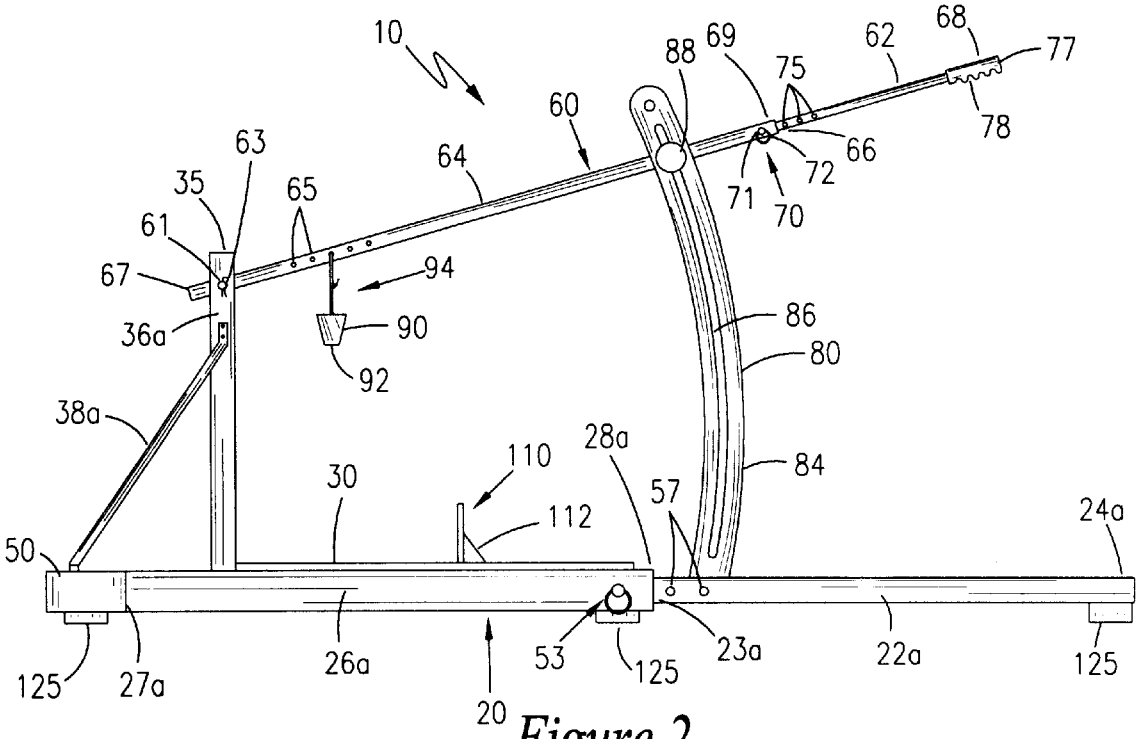
FIG. 2 is a side elevational view of the present invention according to the preferred embodiment shown with a handle in a raised position.
Figure 3:
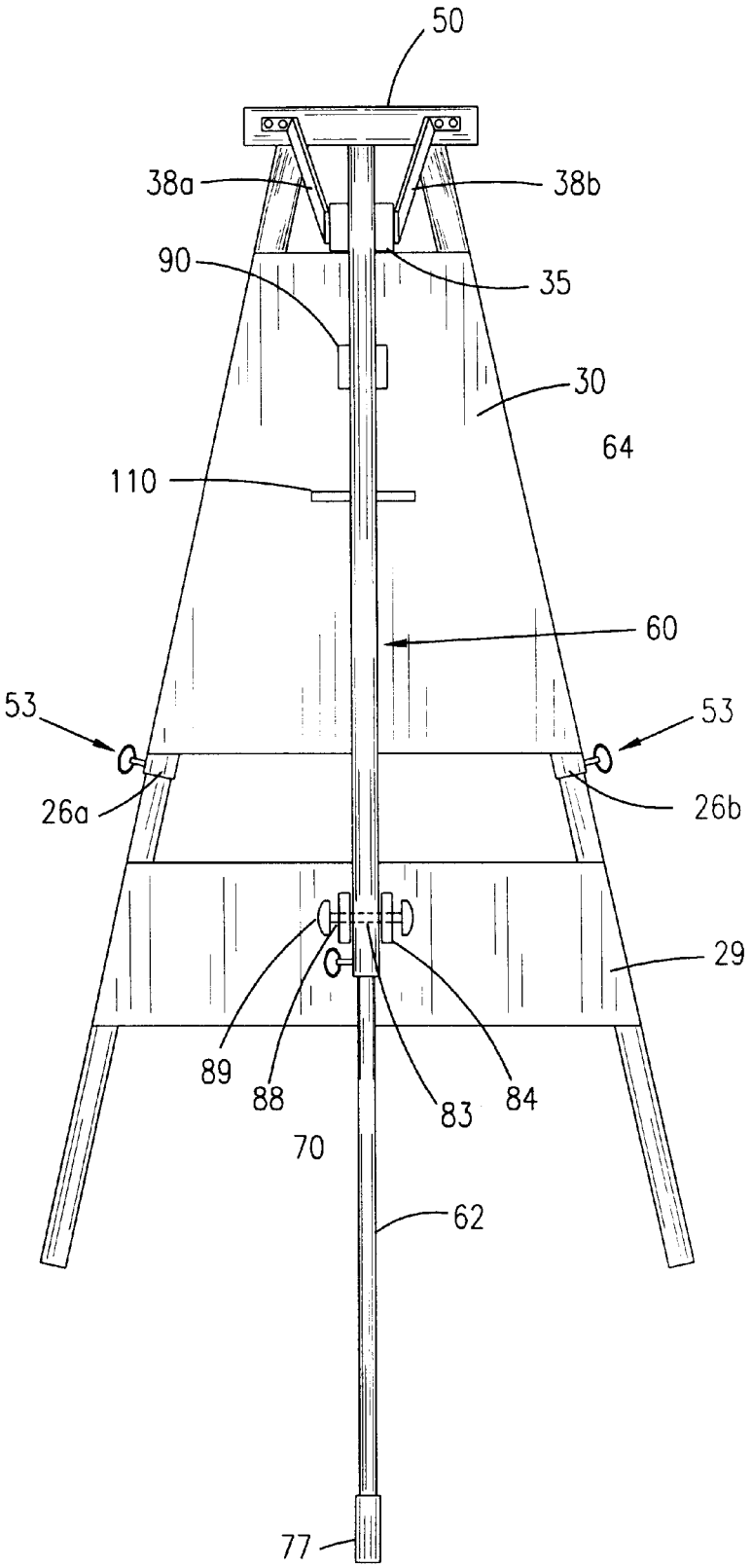
FIG. 3 is a top plan view thereof.

Referring now to FIGS. 1 and 2, a wedge 90 is disclosed being generally triangular in cross-section having a downwardly directed, sharpened cutting edge 92 and lateral surfaces diverging outwardly with increased distance from the cutting edge 92. The cutting edge 92 of the wedge 90 can be sharpened by a user or replaced should it become damaged.

For being removably inserted within the plurality of holes 65 linearly aligned along a length of the outer member 64 of the handle 60, an L-shaped arm 94 welded perpendicularly along an upper surface of the wedge 90 is disclosed.

The L-shaped arm 94 of the wedge 90 allows for the lateral selective adjustment of the wedge 90 with respect to the linearly aligned holes 65 so as to ensure the wedge 90 is positioned centrally with respect to an end of a log of wood which has been placed on the base platform 30 before actuating the handle 60 of the present invention.

Figure 5A:
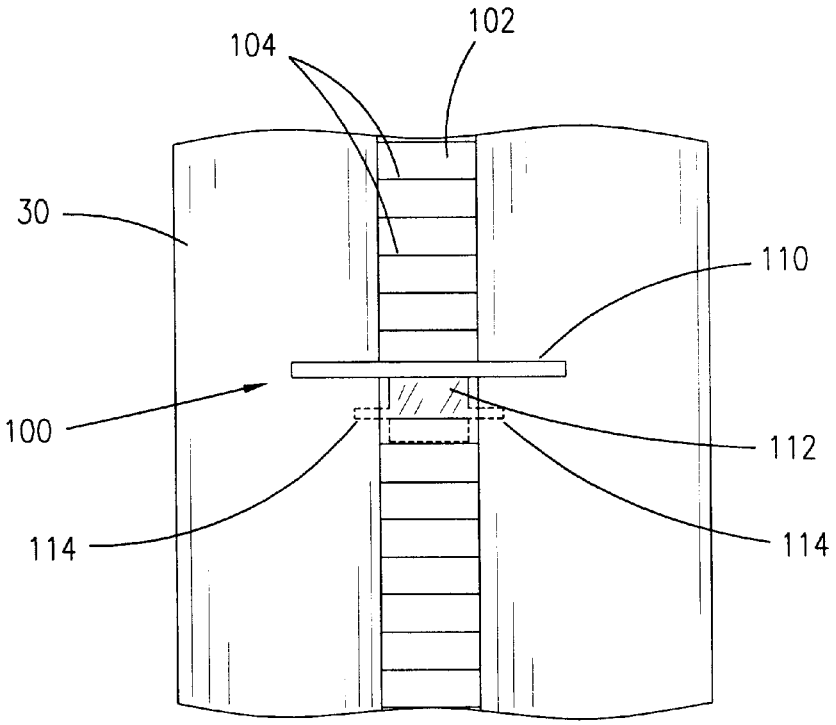
FIG. 5*a* is a top plan view of the track assembly.
Figure 5B:
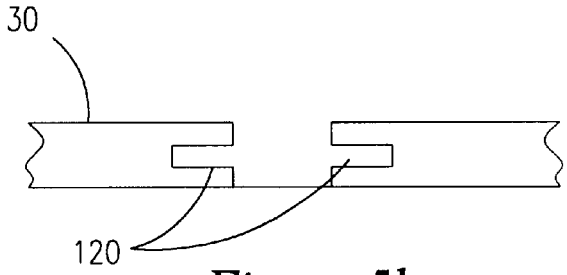
FIG. 5*b* is a front end elevational view of the receiving slot.
Figure 5C:
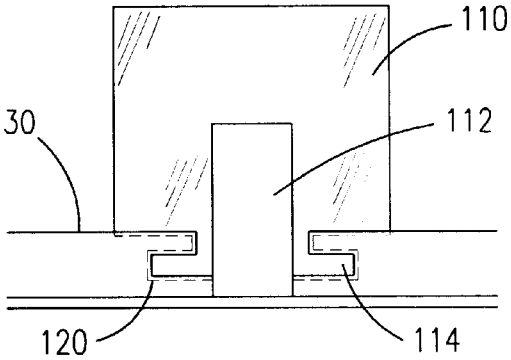
FIG. 5*c* is a front end elevational view of the brace.
Figure 5D:
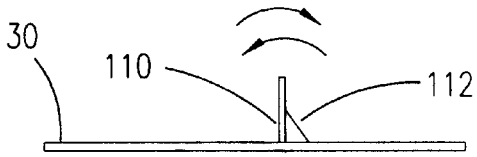
FIG. 5*d* is side elevational view shown depicting the forward and backward tilting action of the brace.
Figure 6:
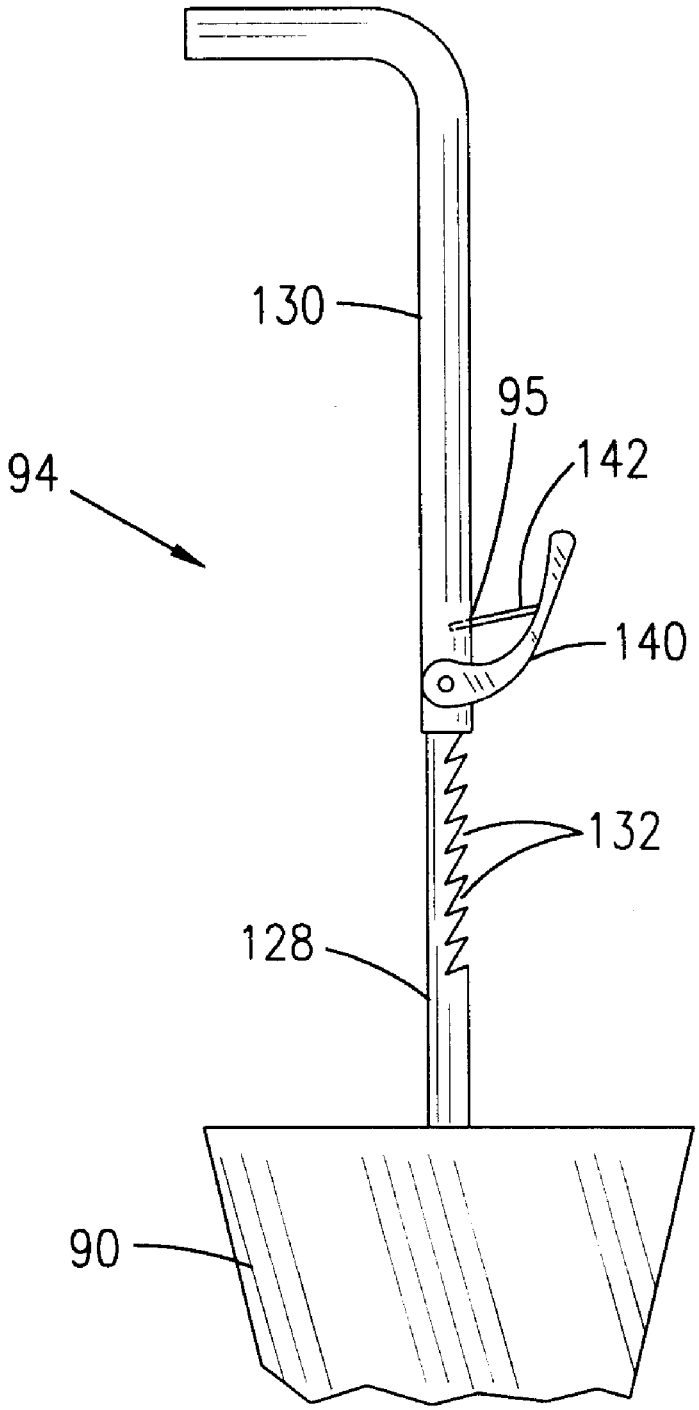
FIG. 6 is a side elevational view of the wedge.

Referring now to FIGS. 5*a,* 5*b,* 5*c,* and 5*d,* in order to securely hold a log in place once positioned on the base platform 30, a track assembly 100 is disclosed which includes a linearly elongated channel 102 formed along a linearly elongated centerline of the upper surface of the base platform 30 and extending just short a length thereof. The channel 102 having a plurality of teeth 104 formed integral therewith and being aligned at spaced locations along a length thereof. The teeth 104 extend outwardly in a direction towards the apex 30. The spacing between the teeth 104 define recesses 106 designed and configured so as to receive an arm 112 of a slidably adjustable brace 110.

The brace 110 is of a generally, rectangular configuration being constructed of steel and having a linearly elongated arm 112 extending from a linearly elongated centerline at an acute angle therefrom.

Once a user positions the arm 112 in a desired recess 106, mechanical interference between the arm 112 and the recess 106 assures firm engagement of the brace 110 with a log, thereby providing an immobilizing means for holding a log in position on the base platform 30.

In order to facilitate lateral movement by the brace 110 along the base platform 30, an adjustable brace receiving slot 120 is formed along opposing inner sidewalls, adjacent to the channel 102, just below the upper surface of the base platform 30 and runs an entire linear length thereof for guidably receiving a pair of elbows 114 of the adjustable brace 110 . The pair of elbows 114 being separated by the arm 112 of the brace 110 with each elbow 114 formed of an L-shaped appendage on the lower surface of the brace 110 and forming a recess below the lower surface thereof. Each of the elbows 114 is guidably received in a loose fashion along a length of the receiving slot 120 thereby allowing the brace 110 to be slightly tilted forward and backward.

Upon a user tilting the brace 110 backward, the arm 112 is effectively removed from a recess 106, thereby removing mechanical interference therebetween, and the brace 110 can be slidably moved along a length of the channel 102 until a desired position is provided. Once a position has been provided, the user tilts the brace 110 forward, thereby inserting the arm 112 into a recess 106 where the arm 112 becomes securely locked therein.

In order to prevent inadvertent movement by the present invention during operation, a plurality of friction pads 125, each of a generally square configuration having a non-skid or textured lower surface for coming into mechanical interference with the ground, is mounted to a lower surface of corners of the bracket base member 50, a lower surface of the anterior ends 27*a,* 27*b* of the outer members 26*a,* 26*b* of the base members 20, and a lower surface of the posterior ends 24*a,* 24*b* of the inner members 22*a,* 22*b* of the base members 20.

2. Operation of the Preferred Embodiment

To use the present invention, a user Next, the user raises the handle 60 from a lower, resting position to an elevated position until the cutting edge 92 of the wedge 90 is clear enough to provide access to positions a log on the base platform 30 with a lower end resting thereon. The brace 110 is laterally adjusted along the channel 102 so as to securely lock the log in position. The user then places the wedge 90 via the L-shaped arm 94 in a desired hole 65 in the outer member 64 of the handle 60 so as to centrally align the wedge 90 with respect to an end of the log. The telescopic handle 60 can then be adjusted by the user for providing adequate leverage for cutting the log.

Next, the user lowers the handle 60 from a lower, resting position to an elevated position until the cutting edge 92 of the wedge 90 rests on the upper end of the log. The user then applies a transverse force on the handle 60 through an arcuate motion as the guide pin 88 in the handle 60 slidably engages the elongated slots 86 of the track arms 84 to a lowered position, thereby splitting the log of wood.

Mechanical advantage is provided via the fulcrum pin 61, the handle support post 35, and the elongated handle 60 so as to allow a user to split logs using minimal transverse force.

In the event the log is not split by the time the handle 60 reaches the lowered position, the same operation is repeated with the user having the option of further extending the telescopic handle 60 and/or vertically extending the L-shaped arm 94 so as to provide added leverage. This operation is continued as many times as is necessary until the log has been fully split.

The use of the present invention allows wood logs to be split into firewood using human strength alone with minimal impact on the environment in a manner which is quick, easy and efficient.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. An adjustable, portable wood splitting apparatus comprising:

a pair of linearly elongated, telescoping cylindrical base members forming a V-shaped base diverging outwardly from an apex;

a bracket base member, a linearly elongated, vertically extending handle support post;

a linearly elongated, telescoping handle mounted above said apex and on a vertically extending handle support post, said handle positioned with respect to the base members such that the handle bisects the V-shaped angle formed by the base members; and a wedge vertically affixed to said handle.

2. The wood splitting apparatus of claim 1, wherein each of the pair of base members is of a generally rectangular configuration and includes an inner member telescoping inside an outer member for providing a retractable device being easily transportable;

wherein each said inner member has an anterior end opposite a posterior end, and the anterior end of each of the inner members telescopes inside the posterior end of each of the outer members, respectively.

3. The wood splitting apparatus of claim 2, further comprising a spring-loaded pin assembly for holding inner member and outer member into their desired position.

4. The wood splitting apparatus of claim 1, further comprising an upper surface of a base platform for serving as a platform upon which an end of a log can be supported.

5. The wood splitting apparatus of claim 4, wherein said base platform is formed of flattened steel of a generally rectangular configuration, tapering in a direction towards said apex, said base platform affixed to an upper surface of the outer members of the base members above a handle support post and extending to the posterior end of the outer members.

6. The wood splitting apparatus of claim 1, wherein said handle support post is of a generally rectangular, hollow configuration and having a handle receiving slot formed as a recess along an upper surface thereof for receiving an anterior end of an outer member of a handle.

7. The wood splitting apparatus of claim 1, wherein an L-shaped arm of the wedge allows for the lateral selective adjustment of said wedge so as to ensure the wedge is positioned centrally with respect to an end of a log of wood which has been placed on the base platform before actuating said handle.

* * * * *